US006896029B2

(12) United States Patent
Dobesberger et al.

(10) Patent No.: US 6,896,029 B2
(45) Date of Patent: May 24, 2005

(54) PROCESS AND DEVICE FOR MANUFACTURING FREE-FLOWING METAL FOAM

(75) Inventors: Franz Dobesberger, Schwarzenau (AT); Herbert Flankl, Perg (AT); Dietmar Leitlmeier, Schleissheim/Wels (AT)

(73) Assignee: Huette Klein-Reichenbach Gesellschaft m.b.H., Schwarzenau (AT)

( * ) Notice: Subject to any disclaimer, the term of this patent is extended or adjusted under 35 U.S.C. 154(b) by 0 days.

(21) Appl. No.: 10/656,290

(22) Filed: Sep. 8, 2003

(65) Prior Publication Data

US 2004/0076849 A1 Apr. 22, 2004

(30) Foreign Application Priority Data

Sep. 9, 2002 (AT) ..... A 1348/2002

(51) Int. Cl.[7] ..... C22C 1/08
(52) U.S. Cl. ..... 164/79; 75/415; 428/613
(58) Field of Search ..... 75/415, 680; 164/66.1, 164/79, 271, 119

(56) References Cited

U.S. PATENT DOCUMENTS

| | | | | | |
|---|---|---|---|---|---|
| 4,314,835 | A | * | 2/1982 | Pelton | 65/22 |
| 4,582,534 | A | * | 4/1986 | Torobin | 75/229 |
| 5,112,697 | A | * | 5/1992 | Jin et al. | 428/613 |
| 5,281,251 | A | * | 1/1994 | Kenny et al. | 75/415 |
| 5,334,236 | A | * | 8/1994 | Sang et al. | 75/415 |
| 2003/0005793 | A1 | * | 1/2003 | Dobesberger et al. | 75/415 |
| 2003/0034143 | A1 | * | 2/2003 | Nichol et al. | 164/79 |
| 2003/0047036 | A1 | * | 3/2003 | Dobesberger et al. | 75/415 |
| 2003/0051850 | A1 | * | 3/2003 | Asholt et al. | 164/79 |
| 2003/0126949 | A1 | * | 7/2003 | Hur et al. | 75/415 |
| 2004/0093987 | A1 | * | 5/2004 | Fuerst et al. | 75/415 |

FOREIGN PATENT DOCUMENTS

| | | | |
|---|---|---|---|
| AT | 410103 | | 6/2002 |
| AT | 410104 | | 6/2002 |
| CA | 2084038 | * | 5/1993 |
| EP | 0666784 | | 8/1995 |
| JP | 59-129740 | * | 7/1984 |
| JP | 62-286647 | * | 12/1987 |
| JP | 03-017236 | * | 1/1991 |
| JP | 2003-112253 | * | 4/2003 |
| JP | 2003-119526 | * | 4/2003 |
| WO | 01/62416 | | 8/2001 |
| WO | WO 03/074163 | * | 9/2003 |

* cited by examiner

*Primary Examiner*—John J. Zimmerman
(74) *Attorney, Agent, or Firm*—Greenblum & Bernstein, P.L.C.

(57) ABSTRACT

Device and process for manufacturing a metal foam. The device includes at least two feed pipes for introducing gas. The at least two feed pipes are arranged next to one another. Each of the at least two feed pipes project into a foamable melt. The process includes introducing gas into a foamable molten metal from at least two neighboring similarly dimensioned feed pipes projecting into a metallurgical vessel and forming bubbles in an area of ends of the projecting pipe, whereby abutting areas of adjacent bubbles form particle-containing interstructures.

10 Claims, 1 Drawing Sheet

PROCESS AND DEVICE FOR MANUFACTURING FREE-FLOWING METAL FOAM

CROSS-REFERENCE TO RELATED APPLICATIONS

The present application claims priority under 35 U.S.C. §119 of Austrian Patent Application No. A 1348/2002, filed on Sep. 9, 2002, the disclosure of which is expressly incorporated by reference herein in its entirety.

BACKGROUND OF THE INVENTION

1. Field of the Invention

The present invention relates to a process for manufacturing free-flowing metal foam with monomodal distribution of the dimension of the cavities in said foam. More precisely, the invention deals with the preparation of metal foams each with essentially the same pore volumes for use in molded articles with a specific profile of properties. The invention also relates to a device for producing a metal foam. Finally, the invention relates to the use of components which contain a largely homogeneous foam formation.

2. Discussion of Background Information

Metal foam, particularly lightweight metal foam, is being used to an increasing degree in molded articles with a special spectrum of properties, whereby the various requirements must be met with a high degree of certainty. In other words, the molded articles with low weight are supposed to feature high stability with precisely specified mechanical stress and/or be deformable with maximum energy absorption in the case of overload.

Fabricating objects of metal foam is known. For example, a process for manufacturing a foamed article is described in WO 01/62416 A1, according to which an ingot mold is filled with foam by collecting individual bubbles rising in the melt. However, this process, in which the gas bubbles are introduced and isolated for the most part by way of a so-called rotor impeller, has the disadvantages that, on the one hand, filling the ingot mold is slow and, therefore, with a cooled ingot mold wall, the part of the article that was formed last has a frequently disadvantageously thick wall layer, and, on the other hand, the bubble size is embodied variably in an uncontrolled manner. As a result, the mechanical characteristic values of a part or article created in this manner often feature a great dispersion that is unfavorable for the most part.

Another process has become known from EP 0666784 B1, in which a molded casting of the stabilized, fluid foam metal takes place by pressing the stabilized foam into a mold with pressure. However, the cells of the formed foam cannot be produced in a uniform size with this process.

Austrian patent application 936/2001 discloses a device and process for introducing gas into molten metal, whereby a uniformity of the diameter of the respective individual bubbles and the size of the gas bubbles are controlled.

A monomodal distribution of the dimension of the cavities of a molded article made of metal foam as well as a process for manufacturing the same is disclosed by Austrian patent application 935/2001.

However, all the manufacturing methods that can be attributed to the state of the art for free-flowing metal foam share the disadvantage that individual bubbles do not usually connect until they are brought together and often form thickened wedge areas. In addition, it is possible that a desired filling speed of a mold for the purpose of obtaining a uniformly thick surface layer of the article or a preferred metal flow cannot be achieved.

For the most part, the known devices do not permit coherent metal foam bubbles of the same size to be manufactured in such a way that the interstructures between the cavities can be embodied to be thin and perform favorable support functions with regard to a low specific weight with high mechanical characteristic values of the part.

SUMMARY OF THE INVENTION

The invention avoids these disadvantages and provides for a process of the type mentioned at the outset by way of which a free-flowing metal foam with monomodal dimensions of the cavities is generated in a foamable melt at the introduction of gas and is developed further. In addition, the invention relates to a generic device for manufacturing free-flowing foam and for processing of the same.

Finally, the invention relates to a use of the foam formed in the melt.

The invention also provides for a process in accordance with the invention wherein gas is introduced into a foamable molten metal from at least two neighboring, similarly dimensioned feed pipes. These feed pipes project into a metallurgical vessel. Bubbles are formed therein in the area of the projecting pipe ends. In this way, a coherent foam formation is obtained. Moreover, abutting areas of the bubble surfaces are provided, and particle-containing interstructures are formed and developed further.

The advantages achieved with the invention can essentially be seen in a favorable foam structure, because the interstructures of a foam formation already form during the development of the pores in the fluid foamable metal, which walls are thereby formed thinly and geometrically in accordance with the dynamic effects. Depending upon the planned and/or desired pore sizes, with respect to a quantity of gas to be introduced, which shall be adhered to within wide limits, the boundary surface tension and the buoyancy of the bubbles for the development of a voluminous foam formation (that is further developed into foamed articles) should thereby be taken into consideration in the surface tension.

According to the invention, it is thereby important that the size of the individual bubbles or cavities in the foam formation is determined by the selection of the distance of the feed pipes from one another and, as known per se, by the geometric embodiment of the pipe ends projecting into the molten metal in accordance with Austrian patent application 936/2001. Advantageous conditions for a similar formation of the bubbles and a desired formation speed for the formation can be created in this way.

If the foam formation is introduced in a favorable manner into a mold or an ingot mold and allowed to solidify there into a dischargeable formed piece, a dense, but extremely thin thickness of the surface layer of the part can be produced with a directly adjacent foam core.

An advantageously precisely limited stability of a lightweight component can be achieved if introducing the foam formation into the mold or ingot mold takes place after an essentially thin-walled solidification of the molten metal on the internal wall of the mold.

The invention also provides for a generic device in that at least two feed pipes for gas projecting into a foamable melt are provided next to one another at a distance from one another.

The advantages of this type of device are essentially substantiated in that bubbles formed on the feed pipe in accordance with Austrian patent application 936/2001 in at least one side area abut against one another and can form an interstructure, through which in the given case the release criteria are met and a subsequent bubble is formed. As a result, through the device in accordance with the invention a favorable accumulation of the cavities in the foamable metal is produced directly upon their creation and an advantageous geometric embodiment of the interstructures of the foam formation is achieved.

The criteria for a formation of foam formations can be improved further if at least one additional feed pipe projecting into the molten mass is provided, which feed pipe is spaced at an equal distance but offset from the connecting line of the first feed pipe.

Particular advantages with respect to a creation of greater foam volumes of the formations can be achieved in accordance with an embodiment of the invention in that a plurality of feed pipes projecting into the melt are embodied with the same dimensions and the pipe ends are arranged on one surface.

In order to supply and form components with a low weight and/or with high energy absorption during deformation, it is advantageous in accordance with the invention to use a free-flowing metal foam comprised of a plurality of cavities, formed by an introduction of gas into the area of several equally spaced ends of equally dimensioned feed pipes projecting into a foamable melt. In this way, a monomodal distribution of the dimension of the cavities in a foam formation is created by abutting parts of the respectively growing surfaces of the foam bubbles and a thereby induced size-determining closure of the same with a respective further new formation of cavities.

A use of a foam formation for manufacturing lightweight metal parts is particularly favorable in the automobile industry or in aerospace due to the precise adjustability of the mechanical properties of the parts.

The invention also provides for a process for manufacturing metal foam, the process comprising introducing gas into a foamable molten metal from at least two neighboring similarly dimensioned feed pipes projecting into a metallurgical vessel and forming bubbles in an area of ends of the projecting pipe, whereby abutting areas of adjacent bubbles form particle-containing interstructures.

The metal foam may be a free-flowing metal foam having a monomodal distribution of cavity dimensions. The process may further comprise determining a size of individual bubbles based upon a distance between adjacent feed pipes. The bubbles may comprise cavities and the process may further comprise determining a size of individual cavities based upon a distance between adjacent feed pipes. The introducing may comprise introducing gas into one of a mold and an ingot mold. The process may further comprise allowing the metal foam to solidify. The process may further comprise forming a dischargeable member having the solidified metal foam. The introducing may comprise introducing the gas into a mold after an essentially thin-walled solidification stage occurs. The mold may comprise an ingot mold. The essentially thin-walled solidification stage may comprise allowing molten metal to solidify on an internal wall of the mold.

The invention also provides for a device for manufacturing a metal foam, wherein the device comprises at least two feed pipes for introducing gas. The at least two feed pipes are arranged next to one another. Each of the at least two feed pipes project into a foamable melt.

The at least two feed pipes may be arranged at a distance from one another. A size of individual bubbles may be based upon the distance. The metal foam may be a free-flowing metal foam having a monomodal distribution of cavity dimensions. The device may further comprise at least one additional feed pipe, wherein each of the feed pipes projects into a molten mass. The at least one additional feed pipe may be arranged offset relative to one of the at least two feed pipes. The at least one additional feed pipe may be spaced at an equal distance from each of the at least two feed pipes. The at least two feed pipes may comprise ends which are substantially similarly shaped. The ends may be arranged on at least one of a common plane and a common surface. The at least two feed pipes may be substantially similarly shaped and sized. The ends may be arranged on at least one of a common plane and a common surface.

The invention also provides for a metal foam comprising a plurality of cavities formed by introduction of a gas into an area wherein several equally spaced ends of equally dimensioned feed pipes project into a foamable melt. The cavities are arranged in a monomodal distribution and adjacent cavities abut one another.

The adjacent cavities that abut one another may grow together by introducing the gas. The cavities may comprise a substantially predetermined size. The cavities may comprise a substantially predetermined shape. The metal foam may be included in a component having a relatively low weight. The metal foam may be included in a component having a relatively high energy absorption during deformation.

The invention also provides for a lightweight metal part comprising the foam metal described above. The lightweight metal part may comprise an automobile part. The lightweight metal part may comprise an aerospace part.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
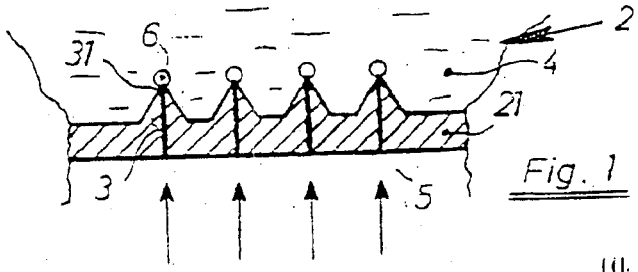
FIG. 1 shows a stage wherein bubbles on feed pipes are starting to form in the foamable molten metal.

FIG. 1 shows diagrammatically a so-called blowing-in of a foam formation, whereby gas 5 is injected into a foamable melt 4 through feed pipes 3 from a pressure chamber under a nozzle assembly 21 of a metallurgical vessel 2, whereby gas bubbles 6 are formed in the area of the projecting pipe ends 31. Corresponding to physical laws, equally sized bubbles 6 are formed through an equally high gas pressure and the same feed pipe and pipe end dimensions, whereby, however, the respective bubble size can be determined and/or controlled, if necessary, by varying injection conditions.

Figure 2:
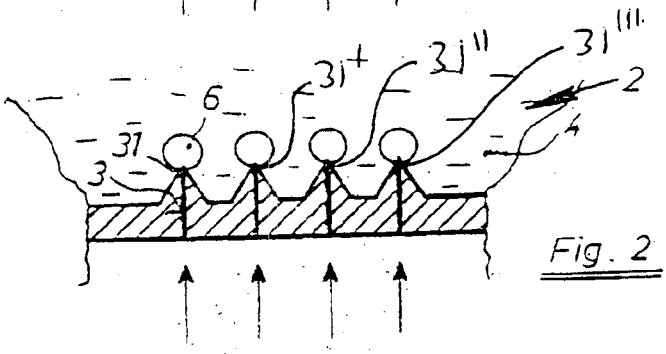
FIG. 2 shows the bubbles becoming enlarged.

FIG. 2 shows a gas bubble enlargement 6 in front of the pipe ends 31 in a foamable melt 4 in a metallurgical vessel 2.

Figure 3:
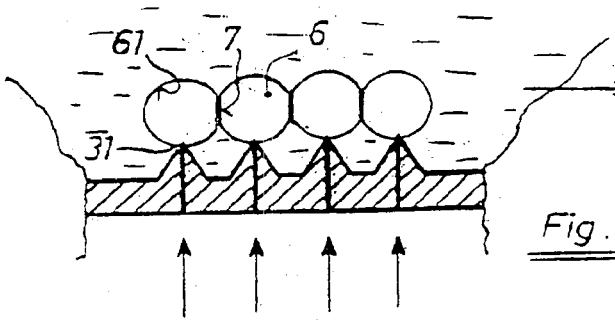
FIG. 3 shows an embodiment of interstructures formed between the bubbles.
Figure 3A:
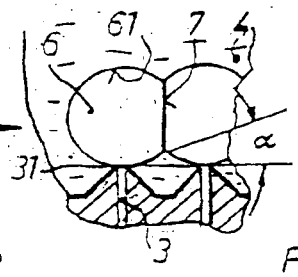
FIG. 3*a* shows a detail view of FIG. 3.

When bubbles 6 that adhere to the ends 31 of the feed pipes 3 have each reached a size determined by the distance "A" between the injection pipes, and their surface 61 abuts against that of a neighboring bubble, in most cases an interstructure 7 is directly generated, as shown in FIG. 3. Through a change of the local surface tensions in the area of the pipe ends 31, as a result of the essentially suddenly enlarging foamable molten metal 4 containing interstructures 7 between the gas bubbles 6 in a particle (as shown in FIG. 3*a*) release criteria of a row of bubbles are brought about directly. This is identified by an angle "α".

Figure 4:
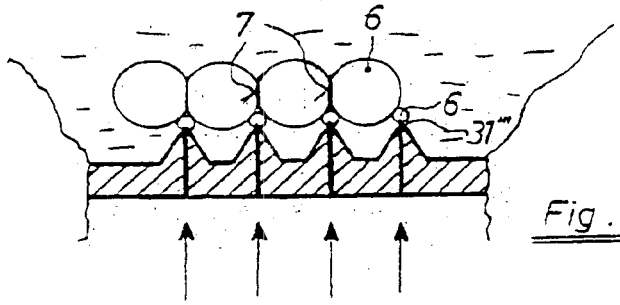
FIG. 4 shows another stage wherein new bubbles are being formed.

Because at this point the introduction of gas into a molten metal is continued further (as shown diagrammatically in FIG. 4), there is a new formation of gas bubbles 6 at the pipe ends 31, 31', 31", 31'". Due to the surface tensions of the gas bubbles 6 and the tendency to form a pack with corresponding surface boundary angles of the cavities, for the most part a lateral shift of a row of essentially equally large bubbles 6 occurs as well as a new formation of said bubbles in the wedges of the interstructures 7 of a row of cavities.

As shown in FIGS. 1 and 2, newly formed bubbles 6 grow until they reach a critical size at which interstructures 7 are again formed and release criteria (FIG. 3, FIG. 3*a*) are essentially abruptly created with the formation of a cavity formation in a melt 4.

Figure 5:
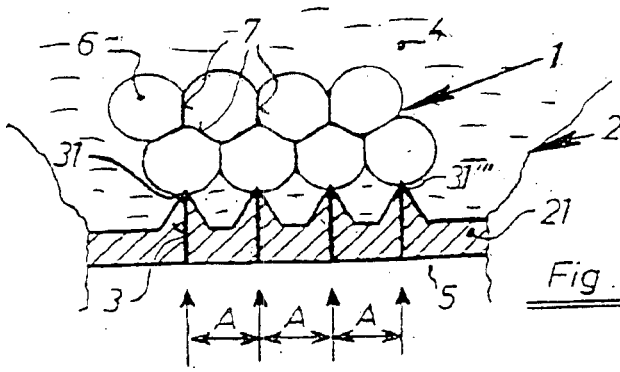
FIG. 5 shows a foam formation stage.

This type of homogeneous cavity or bubble formation 1 is shown diagrammatically in FIG. 5, whereby this formation 1 can be formed botryoidally or in a large volume depending upon the number of feed pipes 3, which is significant for a further development and final shaping of articles.

Favorable conditions for a stable similar formation of a foam formation 1, which can be released by buoyancy itself or by a change in the gas feed criteria of the pipe ends 31, are given if these ends 31 are positioned in multiple rows, preferably in three rows, projecting equally into the melt, whereby each subsequent row is laterally offset by half of the distance A of the ends, however.

An introduction of foam formations 1 into molds is possible in a simple manner due to conformity with Archimedes' law, whereby a monomodal distribution of the dimensions of the cavities 6 occurs with favorable forming of the interstructures 7 in accordance with the invention.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A process for manufacturing metal foam, the process comprising:

introducing gas into a foamable molten metal from at least two neighboring similarly dimensioned feed pipes projecting into a metallurgical vessel;

forming bubbles in an area of ends of the feed pipes;

ensuring that abutting areas of adjacent bubbles form particle-containing interstructures; and at least one of:

forming the particle-containing interstructures of the adjacent bubbles before the bubbles separate from the ends of the feed pipes; and shifting laterally a row of the bubbles before a new row of bubbles is formed.

2. The process of claim 1, wherein the metal foam is a free-flowing metal foam having a monomodal distribution of cavity dimensions.

3. The process of claim 1, further comprising:

determining a size of individual bubbles based upon a distance between adjacent feed pipes.

4. The process of claim 3, wherein the bubbles comprise cavities and wherein the process further comprises:

determining a size of individual cavities based upon a distance between adjacent feed pipes.

5. The process of claim 1, wherein the introducing comprises introducing gas into one of a mold and an ingot mold.

6. The process of claim 5, further comprising:

allowing the metal foam to solidify.

7. The process of claim 6, further comprising:

forming a dischargeable member having the solidified metal foam.

8. The process of claim 1, wherein the introducing comprises introducing the gas into a mold after an essentially thin-walled solidification stage occurs.

9. The process of claim 8, wherein the mold comprises an ingot mold.

10. The process of claim 8, wherein the essentially thin-walled solidification stage comprises allowing molten metal to solidify on an internal wall of the mold.

* * * * *